United States Patent [19]

Walls

[11] Patent Number: 4,879,787

[45] Date of Patent: Nov. 14, 1989

[54] SHOE LACE KNOT SECURING DEVICE

[76] Inventor: Thomas J. Walls, 4201 E. Maple Manor, Muncie, Ind. 47302

[21] Appl. No.: 252,469

[22] Filed: Oct. 3, 1988

[51] Int. Cl.[4] ..... F16G 11/00

[52] U.S. Cl. ..... 24/712.2; 24/306

[58] Field of Search ..... 24/119, 117, 143 R, 24/143 A, 140, 306; 36/50; 2/DIG. 6

[56] References Cited

U.S. PATENT DOCUMENTS

| | | | |
|---|---|---|---|
| D. 270,779 | 10/1983 | Steinberg . | |
| 791,737 | 6/1905 | Walter | 24/119 |
| 1,446,663 | 2/1923 | Sandberg | 24/117 R |
| 2,035,174 | 3/1936 | McIlhenny | 24/119 |
| 3,327,410 | 6/1967 | Park, Sr. et al. | 36/50 |
| 3,638,284 | 2/1972 | Baker | 24/306 |
| 4,096,977 | 6/1978 | Barville et al. | 2/DIG. 6 |
| 4,120,052 | 10/1978 | Butler | 2/DIG. 6 |
| 4,126,951 | 11/1978 | Antonious . | |
| 4,247,967 | 2/1981 | Swinton . | |
| 4,282,657 | 8/1981 | Antonious . | |
| 4,291,439 | 9/1981 | Riti . | |
| 4,327,837 | 5/1982 | Ross | 24/306 |
| 4,553,293 | 11/1985 | Blum | 24/119 |
| 4,571,854 | 2/1986 | Edens | 36/50 |
| 4,639,980 | 2/1987 | Peterson | 24/306 |
| 4,776,043 | 10/1988 | Coleman | 2/DIG. 6 |

*Primary Examiner*—Victor N. Sakran

*Attorney, Agent, or Firm*—John H. Calhoun, Jr.

[57] ABSTRACT

A shoe lace knot securing device comprising a body, a pair of straps each having two ends wherein one end of each strap is permanently attached to one end of the said body and the other end of each strap is free and wherein the said straps extend outward from the said end of the said body, and an anchor loop provide at the other end of the said body, wherein the said body is provided with a fastener adapted to coact with a fastener on each of the said straps to detachably couple the free end of each of the said straps to the said body, and wherein each of the said straps is provided with a fastener adapted to coact with a fastener on the said body to detachably couple the said free ends of the said straps to the said body.

53 Claims, 1 Drawing Sheet

SHOE LACE KNOT SECURING DEVICE

BACKGROUND OF THE INVENTION

The present invention relates to an improved knot securing device, that is a device that is used for locking bow knots in place, particularly but not exclusively on children's shoes and on athletic type shoes such as tennis shoes.

Conventional shoes are provided with laces or other fasteners to act as closure means. Professional athletes, joggers, young children and, in fact, all who wear shoes fastened with laces are often faced with the annoyance of bow-knots which become untied at inconvenient or hazardous times.

Ordinary laces readily loosen and become undone because they are formed of relatively smooth woven yarn materials. Only the inherent friction of the lace surface and the snugness of the knot formed by the wearer determine the period of time which a knot will remain tied. The present invention offers a simple, inexpensive means for locking bow-knots in place, and thus reduces the likelihood that a knot will become loose or untied at an inconvenient or hazardous time.

Knot securing devices are known in the prior art as illustrated by U.S. Pat. No. 4,291,439 issued to Alfred A. Riti on Sept. 29, 1981 which shows a knot-securing device for the laces of shoes and other laced articles comprising a strap having adjoining surfaces of hook and loop elements, which strap is positioned to surround and contact the knot when the hook surface is brought into contact with the loop surface. An anchoring element may be fixed to the device to secure it to the lace.

Also shown in the prior art is Design Patent No. Des. 270,779 which issued on Oct. 4, 1983 to John E. Steinberg.

Also shown in the prior art is U.S. Pat. No. 4,247,967 issued to Walter C. Swinton on Feb. 3, 1981 which shows a slip-resistant binding formed by attaching male and female-type VELCRO® strips along ends of a shoe lace or other binding material such that fasteners of opposite type automatically engage one another at every point where the lace or binding crosses.

Applicant is also aware of U.S. Pat. No. 4,282,657 which issued to Anthony J. Antonious on Aug. 11, 1981, and which shows a heel restraint with an adjustable and flexible closure assembly for shoes utilizing separable fastening members having coacting, flexible gripping elements such as hook and loop fastening means to fasten the shoe.

Applicant is also aware of U.S. Pat. No. 4,126,951 which issued on Nov. 28, 1978 to Anthony J. Antonious for a shoe closure assembly and shawl utilizing a hook and loop VELCRO®-type fastener.

The present invention provides a novel and useful shoe lace knot securing device that can be used with almost any kind of shoe that employs a lace as a closure device.

SUMMARY OF THE INVENTION

The shoe lace knot securing device of the present invention has the advantages of similar devices known in the prior art, and in addition it provides several distinct and important advantages not found in previously known devices.

A problem with knot securing devices heretofore known in the art is that many such devices require that the ends of a lace be inserted through eyelets formed in an anchor, shawl or other member before tying a knot. Several of the previously known devices employ hook and loop VELCRO®-type fastener materials, but most do not employ such materials in such a way as to engage the surfaces of shoe laces. A common problem with previously known devices is that the devices are separated from the shoe when the lace is untied, thereby increasing the risk that the device will become misplaced or lost. Previously known devices are frequently designed in such a way that they get in the way of a wearer when he or she is attempting to tie a shoe lace.

A primary objective of the present invention is to provide a shoe lace knot securing device that is semi-permanently fastenable to a shoe. Another objective of the present invention is to provide a device that does not require the ends of a lace to be inserted through eyelets or the like before tying a knot. Another objective of the present invention is to provide a device in which the hook and loop surfaces of VELCRO®-like fasteners is in contact with the cottony fibers of shoe laces, thus providing increased resistance to movement by the laces. Another objective of the present invention is to provide a device that may be easily adapted to display a light reflective area so that joggers or others wearing the device may be more easily seen at night. Another objective of the present invention is to provide a device that may be easily adapted to display a logo that may be light reflective if such is desired. Another object of the present invention is to provide a device that can, without removing the device from the shoe, be laid out of the way so as not to interfere when a wearer is tying his or her shoe laces.

Another object of the present invention is to provide a shoe lace knot securing device that is simple in construction, inexpensive, strong and durable, and well adapted for the purposes for which it is designed.

Other objects and advantages of the present invention will become apparent from a consideration of the following detailed description taken in connection with the accompanying drawings wherein a preferred embodiment of the invention are shown.

It should be understood that the invention is not limited to the details disclosed, but includes all such variations and modifications as fall within the spirit of the invention and the scope of the appended claims.

This invention contemplates knot securing devices of different sizes for use with different size shoes.

The objectives of the present invention are accomplished by providing a shoe lace knot securing device comprising a trapezoidal body having an upper end and a lower end and having extending from the upper end a pair of straps each of which is adapted to encircle one side of a bow-knot and to engage the bow and to restrain the bow from moving and becoming untied. A loop is provided at the lower end of the body for semi-permanently securing the device to a shoe. The top surface of the body is adapted for receiving permanently or detachably coupled thereto a light reflector or a logo that may be light reflecting if so desired. The bottom of the device is provided with a VELCRO®-like surface for engaging a shoe lace at all points of contact between the device and the lace.

BRIEF DESCRIPTION OF THE DRAWINGS

A preferred embodiment of the present invention is illustrated in the accompanying drawings in which.

DESCRIPTION OF THE PREFERRED EMBODIMENT

Figure 1:
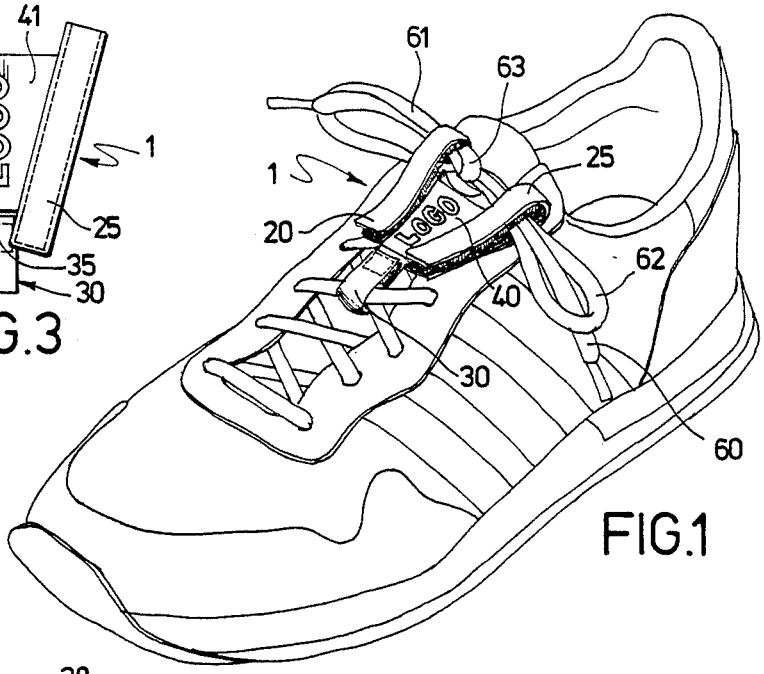
FIG. 1 is a view in perspective of a shoe with the knot securing device of the present invention installed thereon.

Referring now to the drawings in greater detail, FIG. 1 illustrates the shoe lace knot securing device of the present invention, shown generally at 1, installed on a shoe with an anchor loop 30 at the bottom of the device 1 encircling a lace 60 and two straps 20, 25 at the top of the device 1 encircling and securing bows 61, 62 of a knot 63.

Figures 2, 3:
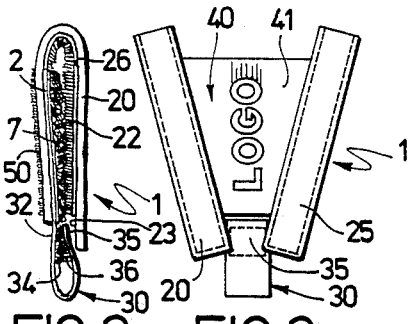
FIG. 2 is a side view of the device.
FIG. 3 is a top plan view of the device with the straps and and anchor strip folded to form loops.
Figure 4:
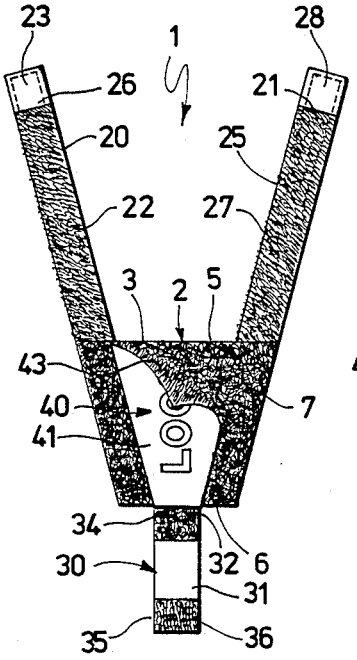
FIG. 4 is a top plan view of the device with the upper right hand corner of a detachable patch pulled back to expose VELCRO ®-like loop fastener.
Figure 5:
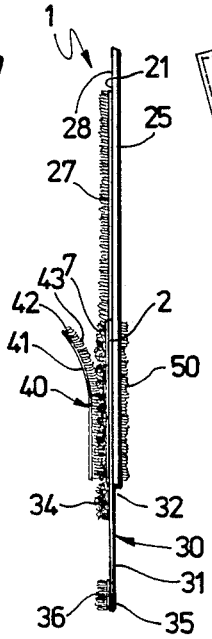
FIG. 5 is a side elevation view of the device.
Figure 6:
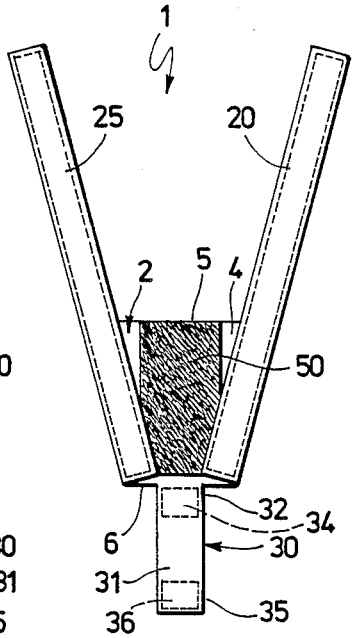
FIG. 6 is a bottom plan view of device.

FIG. 2 shows a side elevation view and FIG. 3 shows a top plan view of the device with an anchor loop 30 formed at the bottom of the device 1 and with the straps 20, 25 folded back on themselves in the manner required for securing laces. FIGS. 4, 5, and 6 show the device 1 with the anchor loop 30 and straps 20, 25 open.

The device 1 comprises a body 2, having a top surface 3, a bottom surface 4, an upper end 5 and a lower end 6. In the illustrated embodiment, the body 1 is shown as having the form of an inverted trapezoid, but other shapes such as triangular or rectangular shapes may be employed.

The top surface 3 of the body 2 is adapted for decoration with a light reflecting material, with a logo or with some other suitable graphic material. Such surface decoration may be placed directly on the top surface 3 of the body 2 or it may be placed on a patch that is permanently attached by stitching or other suitable means to the top surface 3 of the body 2 or it may be placed on a patch that is adapted to be detachably coupled to the top surface 3 of the body 2. In the illustrated embodiment, the top surface 3 of the body 2 has mounted thereon a VELCRO ®-like hook fastener 7 adapted to receive detachably coupled thereto a detachable patch 40 described below.

Extending from the upper end 5 of the body 2 are two flexible straps 20, 25. The top surface 21, 26 of each strap 20, 25 has mounted thereon a pad 22, 27 of a VELCRO ®-like loop fastener 22, 27. The fasteners 22, 27 are made shorter than the straps 20, 25 so that a pad-free grasping area 23, 28 is provided at the distal end of each strap 20, 25.

An anchor loop 30 is provided at the lower end 6 of the device 1. The anchor loop 30 may be formed by stitching two ends of a strip of flexible material 31 to the lower end 6 of the body 2. In that case, a user is required to thread the lace 60 through the anchor loop 30 in order to secure the device 1 to a shoe. Threading may be eliminated by having an openable anchor loop 30 as shown in the illustrated embodiment. The openable anchor loop 30 comprises a strip 31 of flexible fabric-like material free at one end 35 and attached at the other end 32 to the body 2 of the device 1. The top surface 33 of the attached end 32 of the strip 31 has provided mounted thereon a VELCRO ®-like hook fastener 34. At the free end 35 of the strip 31 there is provided on the top surface 33 thereof a VELCRO ®-like loop fastener 36.

In the illustrated embodiment, a detachable patch 40 is mounted on the top surface 3 of the body 2 of the device 1. The patch 40 has a top surface 41 and a bottom surface 42. Mounted on the bottom 42 of the patch 40 is a VELCRO ®-like loop fastener 43. The top surface 41 of the patch 40 is adapted for the placement thereon of a logo, name, or other like graphic material. The top surface 41 of the patch 40 may be made light reflective by using Reflexite ® Microprism sheeting or the like.

Attached to the bottom surface 4 of the body 2 of the device 1 is a VELCRO ®-like loop fastener 50.

It should be understood that where hook and loop elements coact to form a detachable coupling, pairs of elements may be reversed. Thus it can be seen that the fastener 7 on the top 3 of the body 2 might be provided with loop elements provided that the fasteners 22, 27 on the straps 20, 25 are provided with hook elements and provided further that fastener 43 on any detachable patch 40 is also provided with hook elements. Likewise, the fastener 34 at the attached end 32 of an openable anchor strip 31 may be provided with loop elements provided that the fastener 36 at the free end 35 of the strip 31 is provided with hook elements.

When using the shoe lace knot securing device of the present invention, a wearer laces his or her shoes in the usual fashion, but before putting a shoe on, he or she inserts the anchor loop strip 31 under the shoe lace at one of the several places where the lace crosses itself. The strip 31 is folded back on itself and the VELCRO ®-like loop fastener 36 is pressed against the VELCRO ®-like hook fastener 34 to join the two pads together, thus forming a loop 30 adapted to anchor the device 1 to the shoe. The shoe is then tied in the usual fashion. Thereafter the straps 20, 25 are placed under bows 61, 62 formed in a lace 60 and are folded back across the tops of the bows 61, 62 and back onto the body 2 of the device 1. The VELCRO ®-like loop fasteners 22, 27 on the surfaces 21, 26 of the straps 20, 25 are then pressed against the VELCRO ®-like hook fastener 7 on the top 3 of the body 2 of the device 1. The body 2 of the device 1 is then pressed firmly against the top of the shoe, so that cottony fibers in the shoe lace may become attached to the VELCRO ®-like loop fastener 50 on the bottom 4 of the body 2 of the device 1. A detachable patch 40 may be attached to the body 2 either before or after the device 1 is mounted on a shoe. This is done by simply pressing the bottom 42 of the patch 40 against the top 3 of the body 2 so that the VELCRO ®-like loop fastener 43 on the bottom 42 of the patch 40 will engage the VELCRO ®-like hook fastener 7 on the top 3 of the body 2.

When properly assembled, the straps 20, 25 grasp and hold the bows 61, 62, thus reducing the risk that a lace will slip in the knot. In addition, cottony fibers on the surface of the lace engage the VELCRO ®-like loop fastener on the pads 22, 27, thus further reducing the likelihood that a lace will slip in the knot. Cottony fibers on the lace engage the VELCRO ®-like loop fastener 50 on the bottom 4 of the body 2, thus further reducing the risk of movement of the lace 60 within a knot 63. Thus it can be seen that three different locking means are employed in the shoe lace knot securing device of the present invention to keep shoe laces tied tightly. In addition, the device tends to hold bows 61, 62 securely in place, thereby reducing any tendency for bows to dangle over the sides of shoes. As a consequence, a wearer is less likely to trip over his or her shoe lace, or to get his or her shoe lace wet or muddy.

To release the lace, a user merely grasps the ends 23, 28 of the straps 20, 25 and pulls the fasteners 22, 27 on the straps 20, 25 away from the fastener 7 on the body 2.

It should be understood that in all cases where VELCRO ®-like fasteners of the hook and loop type coact to form detachable couplings, other forms of fasteners may be used such, for example, as snaps.

Having thus described my invention, what I now claim is:

1. A shoe lace knot securing device comprising a body, a pair of straps each having two ends wherein one end of each strap is permanently attached to one end of the said body and the other end of each strap is free and wherein the said straps extend outward from the said end of the said body, and an anchor loop provide at the other end of the said body, wherein the said body is provided with a fastener adapted to coact with a fastener on each of the said straps to detachably couple the free end of each of the said straps to the said body, and wherein each of the said straps is provided with a fastener adapted to coact with a fastener on the said body to detachably couple the free end of each of the said straps to the said body, and wherein each of the said straps is provided with a loop type fastener adapted to coact with shoe lace fibers to restrain movement of the lace.

2. The shoe lace knot securing device of claim 1 wherein the top of the said body is adapted to display graphic material.

3. The shoe lace knot securing device of claim 1 wherein the top of the said body is adapted to display graphic material; and wherein the bottom of the said body has provided thereon a VELCRO ®-like loop fastener.

4. The shoe lace knot securing device of claim 1 wherein the said top of the said body is provided with a fastener of a first kind adapted to receive detachably coupled thereto a fastener of a second kind mounted on a detachable patch and a detachable patch having provided thereon a fastener of a second kind adapted to be detachably coupled to the said fastener of the said first kind; and having provided on the bottom of the said body a VELCRO ®-like loop fastener.

5. The shoe lace knot securing device of claim 1 wherein the said top of the said body is provided with a VELCRO ®-like fastener of a first kind adapted to receive detachably coupled thereto a VELCRO ®-like fastener of a second kind mounted on a detachable patch and a detachable patch having provided thereon a VELCRO ®-like fastener of a second kind adapted to be detachably coupled to the said VELCRO ®-like fastener of the said first kind; and having provided on the bottom of the said body a VELCRO ®-like loop fastener.

6. The shoe lace knot securing device of claim 1 wherein the said anchor loop comprises a strip formed into a loop and fastened at both ends by suitable means to the said body.

7. The shoe lace knot securing device of claim 1 wherein the said anchor loop comprises a strip formed into a loop and fastened at both ends by suitable means to the said body and wherein the top of the said body is adapted to display graphic material.

8. The shoe lace knot securing device of claim 1 wherein the said anchor loop comprises a strip formed into a loop and fastened at both ends by suitable means to the said body and wherein the top of the said body is adapted to display graphic material and wherein the bottom of the said body has provided thereon a VELCRO ®-like loop fastener.

9. The shoe lace knot securing device of claim 1 wherein the said anchor loop comprises a strip formed into a loop and fastened at both ends by suitable means to the said body, and wherein the top of the said body is provided with a fastener of a first kind adapted to receive detachably coupled thereto a fastener of a second kind mounted on a detachable patch and a detachable patch having provided thereon a fastener of a second kind adapted to be detachably coupled to the said fastener of the said first kind; and having provided on the bottom of the said body a VELCRO ®-like loop fastener.

10. The shoe lace knot securing device of claim 1 wherein the said anchor loop comprises a strip formed into a loop and fastened at both ends by suitable means to the said body, and wherein the top of the said body is provided with a VELCRO ®-like fastener of a first kind adapted to receive detachably coupled thereto a VELCRO ®-like fastener of a second kind mounted on a detachable patch and a detachable patch having provided thereon a VELCRO ®-like fastener of a second kind adapted to be detachably coupled to the said VELCRO ®-like fastener of the said first kind; and having provided on the bottom of the said body a VELCRO ®-like loop fastener.

11. The shoe lace knot securing device of claim 1 wherein the said anchor loop comprises a strip attached at one end to the said body and having provided at the said attached end a fastener of a first kind and having provided at the other end thereof a fastener of a second kind wherein the said fasteners are adapted to be detachably coupled to each other to form a loop.

12. The shoe lace knot securing device of claim 1 wherein the said anchor loop comprises a strip attached at one end to the said body and having provided at the said attached end a fastener of a first kind and having provided at the other end thereof a fastener of a second kind wherein the said fasteners are adapted to be detachably coupled to each other to form a loop and wherein the top of the said body is adapted to display graphic material.

13. The shoe lace knot securing device of claim 1 wherein the said anchor loop comprises a strip attached at one end to the said body and having provided at the said attached end a fastener of a first kind and having provided at the other end thereof a fastener of a second kind wherein the said fasteners are adapted to be detachably coupled to each other to form a loop and wherein the top of the said body is adapted to display graphic material and wherein the bottom of the said body has provided thereon a VELCRO ®-like loop fastener.

14. The shoe lace knot securing device of claim 1 wherein the said anchor loop comprises a strip attached at one end to the said body and having provided at the said attached end a fastener of a first kind and having provided at the other end thereof a fastener of a second kind wherein the said fasteners are adapted to be detachably coupled to each other to form a loop and wherein the top of the said body is provided with a fastener of a first kind adapted to receive detachably coupled thereto a fastener of a second kind mounted on a detachable patch and a detachable patch having provided thereon a fastener of a second kind adapted to be detachably coupled to the said fastener of the said first kind; and having provided on the bottom of the said body a VELCRO ®-like loop fastener.

15. The shoe lace knot securing device of claim 1 wherein the said anchor loop comprises a strip attached at one end to the said body and having provided at the said attached end a fastener of a first kind and having provided at the other end thereof a fastener of a second kind wherein the said fasteners are adapted to be detachably coupled to each other to form a loop and wherein the said top of the said body is provided with a VELCRO ®-like fastener of a first kind adapted to receive detachably coupled thereto a VELCRO ®-like fastener of a second kind mounted on a detachable patch and a detachable patch having provided thereon a VELCRO ®-like fastener of a second kind adapted to be detachably coupled to the said VELCRO ®-like fastener of the said first kind; and having provided on the bottom of the said body a VELCRO ®-like loop fastener.

16. The shoe lace knot securing device of claim 1 wherein the said anchor loop comprises a strip attached at one end to the said body and having provided at the said attached end a VELCRO ®-like fastener of a first kind and having provided at the other end thereof a VELCRO ®-like fastener of a second kind wherein the said fasteners are adapted to be detachably coupled to each other to form a loop.

17. The shoe lace knot securing device of claim 1 wherein the said anchor loop comprises a strip attached at one end to the said body and having provided at the said attached end a VELCRO ®-like fastener of a first kind and having provided at the other end thereof a VELCRO ®-like fastener of a second kind wherein the said fasteners are adapted to be detachably coupled to each other to form a loop, and wherein the top of the said body is adapted to display graphic material.

18. The shoe lace knot securing device of claim 1 wherein the said anchor loop comprises a strip attached at one end to the said body and having provided at the said attached end a VELCRO ®-like fastener of a first kind and having provided at the other end thereof a VELCRO ®-like fastener of a second kind wherein the said fasteners are adapted to be detachably coupled to each other to form a loop, and wherein the top of the said body is adapted to display graphic material and wherein the bottom of the said body has provided thereon a VELCRO ®-like loop fastener.

19. The shoe lace knot securing device of claim 1 wherein the said anchor loop comprises a strip attached at one end to the said body and having provided at the said attached end a VELCRO ®-like fastener of a first kind and having provided at the other end thereof a VELCRO ®-like fastener of a second kind wherein the said fasteners are adapted to be detachably coupled to each other to form a loop and wherein the top of the said body is provided with a fastener of a first kind adapted to receive detachably coupled thereto a fastener of a second kind mounted on a detachable patch and a detachable patch having provided thereon a fastener of a second kind adapted to be detachably coupled to said fastener of the said first kind; and having provided on the bottom of the said body a VELCRO ®-like loop fastener.

20. The shoe lace knot securing device of claim 1 wherein the said anchor loop comprises a strip attached at one end to the said body and having provided at the said attached end a VELCRO ®-like fastener of a first kind and having provided at the other end thereof a VELCRO ®-like fastener of a second kind wherein the said fasteners are adapted to be detachably coupled to each other to form a loop and wherein the said top of the said body is provided with a VELCRO ®-like fastener of a first kind adapted to receive detachably coupled thereto a VELCRO ®-like fastener of a second kind mounted on a detachable patch and a detachable patch having provided thereon a VELCRO ®-like fastener of a second kind adapted to be detachably coupled to the said VELCRO ®-like fastener of the said first kind; and having provided on the bottom of the said body a VELCRO ®-like loop fastener.

21. The shoe lace knot securing device of claim 1 wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings.

22. The shoe lace knot securing device of claim 1 wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the top of the said body is adapted to display graphic material.

23. The shoe lace knot securing device of claim 1 wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the top of the said body is adapted to display graphic material and wherein the bottom of the said body has provided thereon a Velcro-like loop fastener.

24. The shoe lace knot securing device of claim 1 wherein the said fastener provided on the said body comprises a VELCRO ®-like fastener of a first kind and the said fastener, provided on each of the said straps comprises a VELCRO ®-like fastener of a second kind adapted to coact with the said fastener of the first kind to form detachable couplings and wherein the said top of the said body is provided with a fastener of a first kind adapted to receive detachably coupled thereto a fastener of a second kind mounted on a detachable patch and a detachable patch having provided thereon a fastener of a second kind adapted to be detachably coupled to the said fastener of the said first kind; and having provided on the bottom of the said body a VELCRO ®-like loop fastener.

25. The shoe lace knot securing device of claim 1 wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the said top of the said body is provided with a VELCRO ®-like fastener of a first kind adapted to receive detachably coupled thereto a VELCRO ®-like fastener of a second kind mounted on a detachable patch and a detachable patch having provided thereon a VELCRO ®-like fastener of a second kind adapted to be detachably coupled to the said VELCRO ®-like fastener of the said first kind; and having provided on the bottom of the said body a VELCRO ®-like loop fastener.

26. The shoe lace knot securing device of claim 1 wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the said anchor loop comprises a strip formed into a loop and fastened at both ends by suitable means to the said body.

27. The shoe lace knot securing device of claim 1 wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the said anchor loop comprises a strip formed into a loop and fastened at both ends by suitable means to the said body and wherein the top of the said body is adapted to display graphic material.

28. The shoe lace knot securing device of claim 1 wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the said anchor loop comprises a strip formed into a loop and fastened at both ends by suitable means to the said body and wherein the top of the said body is adapted to display graphic material and wherein the bottom of the said body has provided thereon a VELCRO ®-like loop fastener.

29. The shoe lace knot securing device of claim 1 wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the said anchor loop comprises a strip formed into a loop and fastened at both ends by suitable means to the said body and wherein the top of the said body is provided with a fastener of a first kind adapted to receive detachably coupled thereto a fastener of a second kind mounted on a detachable patch and a detachable patch having provided thereon a fastener of a second kind adapted to be detachably coupled to the said fastener of the said first kind; and having provided on the bottom of the said body a VELCRO ®-like loop fastener.

30. The shoe lace knot securing device of claim 1 wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the said anchor loop comprises a strip formed into a loop and fastened at both ends by suitable means to the said body and wherein the top of the said body is provided with a VELCRO ®-like fastener of a first kind adapted to receive detachably coupled thereto a VELCRO ®-like fastener of a second kind mounted on a detachable patch and a detachable patch having provided thereon a VELCRO ®-like fastener of a second kind adapted to be detachably coupled to the said VELCRO ®-like fastener of the said first kind; and having provided on the bottom of the said body a VELCRO ®-like loop fastener.

31. The shoe lace knot securing device of claim 1 wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the said anchor loop comprises a strip attached at one end to the said body and having provided at the said attached end a fastener of a first kind and having provided at the other end thereof a fastener of a second kind wherein the said fasteners are adapted to be detachably coupled to each other to form a loop.

32. The shoe lace knot securing device of claim 1 wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the said anchor loop comprises a strip attached at one end to the said body and having provided at the said attached end a fastener of a first kind and having provided at the other end thereof a fastener of a second kind wherein the said fasteners are adapted to be detachably coupled to each other to form a loop and wherein the top of the said body is adapted to display graphic material.

33. The shoe lace knot securing device of claim 1 wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the said anchor loop comprises a strip attached at one end to the said body and having provided at the said attached end a fastener of a first kind and having provided at the other end thereof a fastener of a second kind wherein the said fasteners are adapted to be detachably coupled to each other to form a loop and wherein the top of the said body is adapted to display graphic material and wherein, the bottom of the said body has provided thereon a VELCRO ®-like loop fastener.

34. The shoe lace knot securing device of claim 1 wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the said anchor loop comprises a strip attached at one end to the said body and having provided at the said attached end a fastener of a first kind and having provided at the other end thereof a fastener of a second kind wherein the said fasteners are adapted to be detachably coupled to each other to form a loop and wherein the top of the said body is provided with a fastener of a first kind adapted to receive detachably coupled thereto a fastener of a second kind mounted on a detachable patch and a detachable patch having provided thereon a fastener of a second kind adapted to be detachably coupled to the said fastener of the said first kind; and having provided on the bottom of the said body a VELCRO ®-like loop fastener.

35. The shoe lace knot securing device of claim 1 wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the said anchor loop comprises a strip attached at one end to the said body and having provided at the said attached end a fastener of a first kind and having provided at the other end thereof a fastener of a second kind wherein the said fasteners are adapted to be detachably coupled to each other to form a loop and wherein the said top of the said body is provided with a VELCRO ®-like fastener of a first kind adapted to receive detachably coupled thereto a VELCRO ®-like fastener of a second kind mounted on a detachable patch and a detachable patch having provided thereon a VELCRO ®-like fastener of a second kind adapted to be detachably coupled to the said VELCRO ®-like fastener of the said first kind; and having provided on the bottom of the said body a VELCRO ®-like loop fastener.

36. The shoe lace knot securing device of claim 1 wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the said anchor loop comprises a strip attached at one end to the said body and having provided at the said attached end a VELCRO ®-like fastener of a first kind and having provided at the other end thereof a VELCRO ®-like fastener of a second kind wherein the last two said fasteners are adapted to be detachably coupled to each other to form a loop.

37. The shoe lace knot securing device of claim 1 wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the said anchor loop comprises a strip attached at one end to the said body and having provided at the said attached end a VELCRO ®-like fastener of a first kind and having provided at the other end thereof a VELCRO ®-like fastener of a second kind wherein the last two said fasteners are adapted to be detachably coupled to each other to form a loop and wherein the top of the said body is adapted to display graphic material.

38. The shoe lace knot securing device of claim 1 wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the said anchor loop comprises a strip attached at one end to the said body and having provided at the said attached end a VELCRO ®-like fastener of a first kind and having provided at the other end thereof a VELCRO ®-like fastener of a second kind wherein the last two said fasteners are adapted to be detachably coupled to each other to form a loop and wherein the top of the said body is adapted to display graphic material and wherein the bottom of the said body has provided thereon a VELCRO ®-like loop fastener.

39. The shoe lace knot securing device of claim 1 wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the said anchor loop comprises a strip attached at one end to the said body and having provided at the said attached end a VELCRO ®-like fastener of a first kind and having provided at the other end thereof a VELCRO ®-like fastener of a second kind wherein the last two said fasteners are adapted to be detachably coupled to each other to form a loop and wherein the top of the said body is provided with a fastener of a first kind adapted to receive detachably coupled thereto a fastener of a second kind mounted on a detachable patch and a detachable patch having provided thereon a fastener of a second kind adapted to be detachably coupled to the said fastener of the said first kind; and having provided on the bottom of the said body a VELCRO ®-like loop fastener.

40. The shoe lace knot securing device of claim 1 wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the said anchor loop comprises a strip attached at one end to the said body and having provided at the said attached end a VELCRO ®-like fastener of a first kind and having provided at the other end thereof a VELCRO ®-like fastener of a second kind wherein the last two said fasteners are adapted to be detachably coupled to each other to form a loop and wherein the said top of the said body is provided with a VELCRO ®-like fastener of a first kind adapted to receive detachably coupled thereto a VELCRO ®-like fastener of a second kind mounted on a detachable patch and a detachable patch having provided thereon a VELCRO ®-like fastener of a second kind adapted to be detachably coupled to the last said VELCRO ®-like fastener of the said first kind; and having provided on the bottom of the said body a VELCRO ®-like loop fastener.

41. A shoe lace knot securing device comprising a body, a pair of straps each having two ends wherein one end of each strap is permanently attached to one end of the said body and the other end of each strap is free and wherein the said straps extend outward from the said end of the said body, and an anchor loop provide at the other end of the said body, wherein the said body is provided with a fastener adapted to coact with a fastener on each of the said straps to detachably couple the free end of each of the said straps to the said body, and wherein each of the said straps is provided with a fastener adapted to coact with a fastener on the said body to detachably couple the said free ends of the said straps to the said body, and wherein the said anchor loop comprises a strip formed into a loop and fastened at both ends by suitable means to the said body, and wherein the top of the said body is provided with a fastener of a first kind adapted to receive detachably coupled thereto a fastener of a second kind mounted on a detachable patch and a detachable patch having provided thereon a fastener of a second kind adapted to be detachably coupled to the said fastener of the said first kind; and having provided on the bottom of the said body a VELCRO ®-like loop fastener.

42. A shoe lace knot securing device comprising a body, a pair of straps each having two ends wherein one end of each strap is permanently attached to one end of the said body and the other end of each strap is free and wherein the said straps extend outward from the said end of the said body, and an anchor loop provide at the other end of the said body, wherein the said body is provided with a fastener adapted to coact with a fastener on each of the said straps to detachably couple the free end of each of the said straps to the said body, and wherein each of the said straps is provided with a fastener adapted to coact with a fastener on the said body to detachably couple the said free ends of the said straps to the said body, and wherein the said anchor loop comprises a strip formed into a loop and fastened at both ends by suitable means to the said body, and wherein the top of the said body is provided with a VELCRO ®-like fastener of a first kind adapted to receive detachably coupled thereto a VELCRO ®-like fastener of a second kind mounted on a detachable patch and a detachable patch having provided thereon a VELCRO ®-like fastener of a second kind adapted to be detachably coupled to the said VELCRO ®-like fastener of the said first kind; and having provided on the bottom of the said body a VELCRO ®-like loop fastener.

43. A shoe lace knot securing device comprising a body, a pair of straps each having two ends wherein one end of each strap is permanently attached to one end of the said body and the other end of each strap is free and wherein the said straps extend outward from the said end of the said body, and an anchor loop provide at the other end of the said body, wherein the said body is provided with a fastener adapted to coact with a fastener on each of the said straps to detachably couple the free end of each of the said straps to the said body, and wherein each of the said straps is provided with a fastener adapted to coact with a fastener on the said body to detachably couple the said free ends of the said straps to the said body, and wherein the said anchor loop comprises a strip attached at one end to the said body and having provided at the said attached end a fastener of a first kind and having provided at the other end thereof a fastener of a second kind wherein the said fasteners are adapted to be detachably coupled to each other to form a loop and wherein the top of the said body is provided with a fastener of a first kind adapted to receive detachably coupled thereto a fastener of a second kind mounted on a detachable patch and a detachable patch having provided thereon a fastener of a second kind adapted to be detachably coupled to the said fastener of the said first kind; and having provided on the bottom of the said body a VELCRO ®-like loop fastener.

44. A shoe lace knot securing device comprising a body, a pair of straps each having two ends wherein one end of each strap is permanently attached to one end of the said body and the other end of each strap is free and wherein the said straps extend outward from the said end of the said body, and an anchor loop provide at the other end of the said body, wherein the said body is provided with a fastener adapted to coact with a fastener on each of the said straps to detachably couple the free end of each of the said straps to the said body, and wherein each of the said straps is provided with a fastener adapted to coact with a fastener on the said body to detachably couple the said free ends of the said straps to the said body, and wherein the said anchor loop comprises a strip attached at one end to the said body and having provided at the said attached end a fastener of a first kind and having provided at the other end thereof a fastener of a second kind wherein the said fasteners are adapted to be detachably coupled to each other to form a loop and wherein the said top of the said body is provided with a VELCRO ®-like fastener of a first kind adapted to receive detachably coupled thereto a VELCRO ®-like fastener of a second kind mounted on a detachable patch and a detachable patch having provided thereon a VELCRO ®-like fastener of a second kind adapted to be detachably coupled to the said VELCRO ®-like fastener of the said first kind; and having provided on the bottom of the said body a VELCRO ®-like loop fastener.

45. A shoe lace knot securing device comprising a body, a pair of straps each having two ends wherein one end of each strap is permanently attached to one end of the said body and the other end of each strap is free and wherein the said straps extend outward from the said end of the said body, and an anchor loop provide at the other end of the said body, wherein the said body is provided with a fastener adapted to coact with a fastener on each of the said straps to detachably couple the free end of each of the said straps to the said body, and wherein each of the said straps is provided with a fastener adapted to coact with a fastener on the said body to detachably couple the said free ends of the said straps to the said body, and wherein the said anchor loop comprises a strip attached at one end to the said body and having provided at the said attached end a VELCRO ®-like fastener of a first kind and having provided at the other end thereof a VELCRO ®-like fastener of a second kind wherein the said fasteners are adapted to be detachably coupled to each other to form a loop and wherein the top of the said body is provided with a fastener of a first kind adapted to receive detachably coupled thereto a fastener of a second kind mounted on a detachable patch and a detachable patch having provided thereon a fastener of a second kind adapted to be detachably coupled to the said fastener of the said first kind; and having provided on the bottom of the said body a VELCRO ®-like loop fastener.

46. A shoe lace knot securing device comprising a body, a pair of straps each having two ends wherein one end of each strap is permanently attached to one end of the said body and the other end of each strap is free and wherein the said straps extend outward from the said end of the said body, and an anchor loop provide at the other end of the said body, wherein the said body is provided with a fastener adapted to coact with a fastener on each of the said straps to detachably couple the free end of each of the said straps to the said body, and wherein each of the said straps is provided with a fastener adapted to coact with a fastener on the said body to detachably couple the said free ends of the said straps to the said body, and wherein the said anchor loop comprises a strip attached at one end to the said body and having provided at the said attached end a VELCRO ®-like fastener of a first kind and having provided at the other end thereof a VELCRO ®-like fastener of a second kind wherein the said fasteners are adapted to be detachably coupled to each other to form a loop and wherein the said top of the said body is provided with a VELCRO ®-like fastener of a first kind adapted to receive detachably coupled thereto a VELCRO ®-like fastener of a second kind mounted on a detachable patch and a detachable patch having provided thereon a VELCRO ®-like fastener of a second kind adapted to be detachably coupled to the said VELCRO ®-like fastener of the said first kind; and having provided on the bottom of the said body a VELCRO ®-like loop fastener.

47. A shoe lace knot securing device comprising a body, a pair of straps each having two ends wherein one end of each strap is permanently attached to one end of the said body and the other end of each strap is free and wherein the said straps extend outward from the said end of the said body, and an anchor loop provide at the other end of the said body, wherein the said body is provided with a fastener adapted to coact with a fastener on each of the said straps to detachably couple the free end of each of the said straps to the said body, and wherein each of the said straps is provided with a fastener adapted to coact with a fastener on the said body to detachably couple the said free ends of the said straps to the said body, and wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the said anchor loop comprises a strip formed into a loop and fastened at both ends by suitable means to the said body and wherein the top of the said body is provided with a fastener of a first kind adapted to receive detachably coupled thereto a fastener of a second kind mounted on a detachable patch and a detachable patch having provided thereon a fastener of a second kind adapted to be detachably coupled to the said fastener of the said first kind; and having provided on the bottom of the said body a VELCRO ®-like loop fastener.

48. A shoe lace knot securing device comprising a body, a pair of straps each having two ends wherein one end of each strap is permanently attached to one end of the said body and the other end of each strap is free and wherein the said straps extend outward from the said end of the said body, and an anchor loop provide at the other end of the said body, wherein the said body is provided with a fastener adapted to coact with a fastener on each of the said straps to detachably couple the free end of each of the said straps to the said body, and wherein each of the said straps is provided with a fastener adapted to coact with a fastener on the said body to detachably couple the said free ends of the said straps to the said body, and wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the said anchor loop comprises a strip formed into a loop and fastened at both ends by suitable means to the said body and wherein the top of the said body is provided with a VELCRO ®-like fastener of a first kind adapted to receive detachably coupled thereto a VELCRO ®-like fastener of a second kind mounted on a detachable patch and a detachable patch having provided thereon a VELCRO ®-like fastener of a second kind adapted to be detachably coupled to the said VELCRO ®-like fastener of the said first kind; and having provided on the bottom of the said body a VELCRO ®-like loop fastener.

49. A shoe lace knot securing device comprising a body, a pair of straps each having two ends wherein one end of each strap is permanently attached to one end of the said body and the other end of each strap is free and wherein the said straps extend outward from the said end of the said body, and an anchor loop provide at the other end of the said body, wherein the said body is provided with a fastener adapted to coact with a fastener on each of the said straps to detachably couple the free end of each of the said straps to the said body, and wherein each of the said straps is provided with a fastener adapted to coact with a fastener on the said body to detachably couple the said free ends of the said straps to the said body, and wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the said anchor loop comprises a strip attached at one end to the said body and having provided at the said attached end a a fastener of a first kind and having provided at the other end thereof a fastener of a second kind wherein the said fasteners are adapted to be detachably coupled to each other to form a loop and wherein the top of the said body is provided with a fastener of a first kind adapted to receive detachably coupled thereto a fastener of a second kind mounted on a detachable patch and a detachable patch having provided thereon a fastener of a second kind adapted to be detachably coupled to the said fastener of the said first kind; and having provided on the bottom of the said body a VELCRO ®-like loop fastener.

50. A shoe lace knot securing device comprising a body, a pair of straps each having two ends wherein one end of each strap is permanently attached to one end of the said body and the other end of each strap is free and wherein the said straps extend outward from the said end of the said body, and an anchor loop provide at the other end of the said body, wherein the said body is provided with a fastener adapted to coact with a fastener on each of the said straps to detachably couple the free end of each of the said straps to the said body, and wherein each of the said straps is provided with a fastener adapted to coact with a fastener on the said body to detachably couple the said free ends of the said straps to the said body, and wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the said anchor loop comprises a strip attached at one end to the said body and having provided at the said attached end a fastener of a first kind and having provided at the other end thereof a fastener of a second kind wherein the said fasteners are adapted to be detachably coupled to each other to form a loop and wherein the said top of the said body is provided with a VELCRO ®-like fastener of a first kind adapted to receive detachably coupled thereto a VELCRO ®-like fastener of a second kind mounted on a detachable patch and a detachable patch having provided thereon a VELCRO ®-like fastener of a second kind adapted to be detachably coupled to the said VELCRO ®-like fastener of the said first kind; and having provided on the bottom of the said body a VELCRO ®-like loop fastener.

51. A shoe lace knot securing device comprising a body, a pair of straps each having two ends wherein one end of each strap is permanently attached to one end of the said body and the other end of each strap is free and wherein the said straps extend outward from the said end of the said body, and an anchor loop provide at the other end of the said body, wherein the said body is provided with a fastener adapted to coact with a fastener on each of the said straps to detachably couple the free end of each of the said straps to the said body, and wherein each of the said straps is provided with a fastener adapted to coact with a fastener on the said body to detachably couple the said free ends of the said straps to the said body, and wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the said anchor loop comprises a strip attached at one end to the said body and having provided at the said attached end a VELCRO ®-like fastener of a first kind and having provided at the other end thereof a VELCRO ®-like fastener of a second kind wherein the last two said fasteners are adapted to be detachably coupled to each other to form a loop and wherein the top of the said body is adapted to display graphic material and wherein the bottom of the said body has provided thereon a VELCRO ®-like loop fastener.

52. A shoe lace knot securing device comprising a body, a pair of straps each having two ends wherein one end of each strap is permanently attached to one end of the said body and the other end of each strap is free and wherein the said straps extend outward from the said end of the said body, and an anchor loop provide at the other end of the said body, wherein the said body is provided with a fastener adapted to coact with a fastener on each of the said straps to detachably couple the free end of each of the said straps to the said body, and wherein each of the said straps is provided with a fastener adapted to coact with a fastener on the said body to detachably couple the said free ends of the said straps to the said body, and wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the said anchor loop comprises a strip attached at one end to the said body and having provided at the said attached end a VELCRO ®-like fastener of a first kind and having provided at the other end thereof a VELCRO ®-like fastener of a second kind wherein the last two said fasteners are adapted to be detachably coupled to each other to form a loop and wherein the top of the said body is provided with a fastener of a first kind adapted to receive detachably coupled thereto a fastener of a second kind mounted on a detachable patch and a detachable patch having provided thereon a fastener of a second kind adapted to be detachably coupled to the said fastener of the said first kind; and having provided on the bottom of the said body a VELCRO ®-like loop fastener.

53. A shoe lace knot securing device comprising a body, a pair of straps each having two ends wherein one end of each strap is permanently attached to one end of the said body and the other end of each strap is free and wherein the said straps extend outward from the said end of the said body, and an anchor loop provide at the other end of the said body, wherein the said body is provided with a fastener adapted to coact with a fastener on each of the said straps to detachably couple the free end of each of the said straps to the said body, and wherein each of the said straps is provided with a fastener adapted to coact with a fastener on the said body to detachably couple the said free ends of the said straps to the said body, and wherein the said fastener provided on the said body comprises a VELCRO ®-like fastener of a first kind and the said fastener provided on each of the said straps comprises a VELCRO ®-like fastener of a second kind adapted to coact with the said fastener of the first kind to form detachable couplings and wherein the said anchor loop comprises a strip attached at one end to the said body and having provided at the said attached end a VELCRO ®-like fastener of a first kind and having provided at the other end thereof a VELCRO ®-like fastener of a second kind wherein the last two said fasteners are adapted to be detachably coupled to each other to form a loop and wherein the said top of the said body is provided with a VELCRO ®-like fastener of a first kind adapted to receive detachably coupled thereto a VELCRO ®-like fastener of a second kind mounted on a detachable patch and a detachable patch having provided thereon a VELCRO ®-like fastener of a second kind adapted to be detachably coupled to the last said VELCRO ®-like fastener of the said first kind; and having provided on the bottom of the said body a VELCRO ®-like loop fastener.

* * * * *